US005745000A

United States Patent [19]

Boerstler et al.

[11] Patent Number: 5,745,000

[45] Date of Patent: Apr. 28, 1998

[54] CMOS LOW VOLTAGE CURRENT REFERENCE

[75] Inventors: David William Boerstler, Round Rock; Daniel Mark Dreps, Georgetown, both of Tex.

[73] Assignee: International Business Machines Incorporated, Armonk, N.Y.

[21] Appl. No.: 697,099

[22] Filed: Aug. 19, 1996

[51] Int. Cl.[6] ..... G05F 1/10

[52] U.S. Cl. ..... 327/543; 327/378; 327/538; 327/530; 323/32

[58] Field of Search ..... 327/530, 538, 327/540, 539, 541, 544, 552, 553, 543, 378; 323/312, 313, 315, 316

[56] References Cited

U.S. PATENT DOCUMENTS

| | | | |
|---|---|---|---|
| 5,304,861 | 4/1994 | Fruhauf et al. | 307/296.4 |
| 5,493,533 | 2/1996 | Lambrache | 365/210 |
| 5,572,161 | 11/1996 | Myers | 327/538 |
| 5,578,960 | 11/1996 | Matsumura et al. | 327/538 |

FOREIGN PATENT DOCUMENTS

| | | | |
|---|---|---|---|
| 3079123 | 4/1991 | Japan | 327/538 |

OTHER PUBLICATIONS

Sedra et al., Microelectronic Circuits, 1991, p. 301.

Tham, Khong-Meng, "A Low Supply Voltage High PSRR Voltage Reference on CMOS Process," *IEEE Journal of Solid State Circuits*, vol. 30, No. 5, May 1995, pp. 586–589.

Chapter 3, "Current Sources, Voltage Sources, and References," pp. 178–181 (author, origin and date unknown).

*Primary Examiner*—Margaret Rose Wambach
*Assistant Examiner*—Jung Ho Kim
*Attorney, Agent, or Firm*—Winstead Sechrest & Minick P.C.; Robert D. McCutcheon; Anthony V. S. England

[57] ABSTRACT

A CMOS current reference is provided that is relatively independent of supply voltage and generates a substantially steady current. The current reference includes a plurality of P-channel FETs and a plurality of zero threshold voltage N-channel FETs that provide a high level of voltage supply rejection at relatively low supply voltage levels (1.5 to 3.3 volts). Utilization of the P-channel FETs and the zero threshold voltage N-channel FETs in a current mirror and cascade configuration reduces the sensitivity of the current to variations in the supply voltage. The current reference exhibits higher offset voltage capabilities. In addition, the CMOS current reference may be designed to compensate for process variations since the current will increase as the channel length of the zero threshold voltage N-channel FETs increases.

23 Claims, 1 Drawing Sheet

CM OS LOW VOLTAGE CURRENT REFERENCE

TECHNICAL FIELD OF THE INVENTION

The present invention relates to a current reference and, in particular, to a low voltage CMOS current reference using zero threshold voltage N-channel FETs and having high immunity to variations in supply voltage.

BACKGROUND OF THE INVENTION

Technological improvements in semiconductor processing has led to a substantial increase in the number of transistors fabricated on a single integrated circuit. Along with an increase in the number of transistors also comes an increase in the amount of power dissipated by the integrated circuit. In an effort to reduce power dissipation (or power consumption), designers have reduced the voltage level of the power supplies in such integrated circuits, from the traditional five volts to about 3.3 volts. It is expected that future generation CMOS integrated circuits may operate with a power supply in the range of somewhere between about 1.0 and 3.3 volts.

Generally, very large scale integrated (VLSI) circuits, such as microprocessors, are increasingly using mixed signal circuits (i.e. digital and analog) to perform various functions, such as voltage-controlled and current-controlled oscillators. In addition, other circuits such as D/A (digital-to-analog) converters and multipliers are typically employed in CMOS integrated circuits. In designs utilizing such circuits that generally require a stable reference current, it is imperative to provide a current reference that is relatively independent of changes in the power supply voltage. With the increasing use of low-level power supply voltages, it is even more difficult to provide a needed stable current reference.

Accordingly, there exists a need for a CMOS current reference that provides a stable current and high power supply rejection for use with low-level voltage power supplies in CMOS integrated circuits. Further, there is needed a CMOS current reference having reduced sensitivity to variations in the power supply. In addition, a need exists for a CMOS current reference that does not use substrate PNPs. Also, there exists a need for a current reference capable of compensating for CMOS process variations by increasing the output current as transistor channel length increases.

SUMMARY OF THE INVENTION

According to the present invention, there is provided a CMOS current reference including circuitry coupled to a voltage supply for generating a substantially steady current at a low voltage supply level when a load is coupled to the circuitry. A first circuit is coupled between the circuitry and the voltage supply for minimizing sensitivity of the generated circuit to variations in the voltage supply.

In accordance with the present invention, there is provided a current reference including a first P-channel FET (field-effect transistor) coupled to a voltage supply source and configured to operate in a current source mode. A second zero threshold voltage N-channel FET is coupled to the first FET. A third zero threshold voltage N-channel FET is also coupled to the voltage supply source with the gate electrode of the third FET coupled to the gate electrode of the second FET. The drain electrode of a fourth zero threshold voltage N-channel FET is coupled to the source electrode of the second FET, with the fourth FET outputting a substantially steady current when a load is coupled to the source electrode of the fourth FET. The drain electrode of a fifth N-channel FET is coupled to the source electrode of the third FET, with the gate electrode of the fifth FET coupled to the gate electrode of the fourth FET Additional circuitry is provided to generate a positive voltage at each of the gates of the second FET, the third FET, the fourth FET, and the fifth FET.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is made to the following description taken in conjunction with the accompanying drawings, wherein.

DETAILED DESCRIPTION OF THE INVENTION

Figure 1:
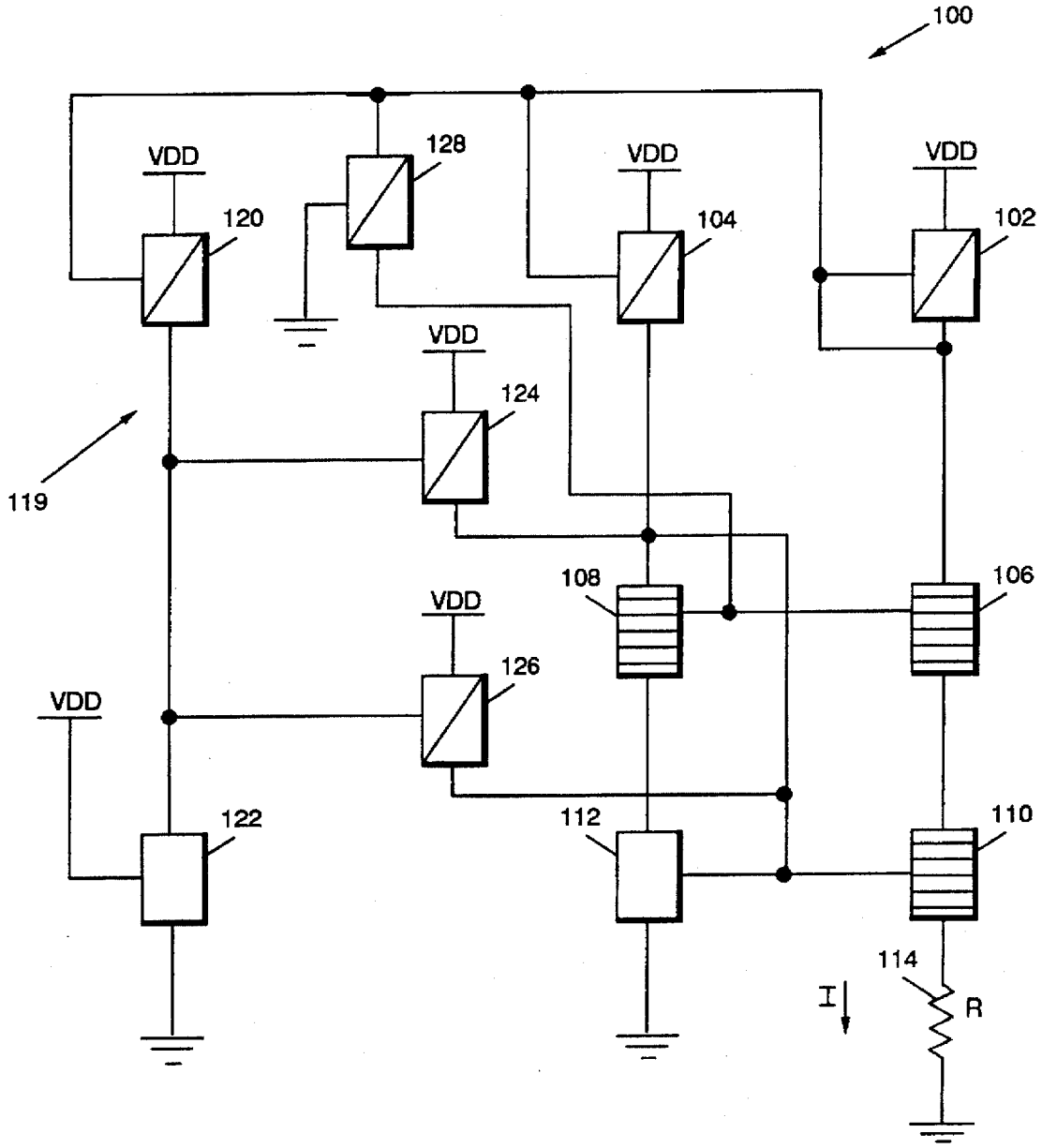
FIG. 1 illustrates a CMOS current reference in accordance with the present invention.

With reference to the drawings, like reference characters designate like or similar parts throughout the drawings. The circuit, being made in the CMOS technology, has its P-channel FETs indicated by a rectangle with a diagonal line formed therein and a gate electrode arranged adjacent thereto and its N-channel FETs indicated by a rectangle without a diagonal line and a gate electrode arranged adjacent thereto. This convention will be followed throughout the FIGURE.

Now referring to FIG. 1, there is shown a CMOS current reference 100 in accordance with the present invention. The current reference includes a P-channel field-effect transistor (FET) 102 configured in a current source mode that is coupled to a supply voltage Vdd, as shown. The source electrode of the FET 102 is coupled to the supply voltage Vdd with the gate electrode of the FET 102 coupled to the drain electrode of the FET 102.

The current reference 100 further includes a zero threshold voltage N-channel FET 106 having its drain electrode coupled to the drain electrode of the FET 102, and another zero threshold voltage N-channel FET 110 having its drain electrode coupled to the source electrode of the FET 106. A "zero threshold voltage" FET is defined as a FET having a threshold voltage Vt of approximately zero volts. Threshold voltage Vt is, generally, the gate electrode to source electrode voltage at which a channel forms between the drain and source electrodes of the FET to allow appreciable current to flow. A zero threshold voltage N-channel FET is indicated in the FIGURE by a rectangle with horizontal hatching and a gate electrode arranged adjacent thereto.

The FET 110 outputs a substantially steady current when a load 114 is coupled to the source electrode of the FET 110. As will be appreciated, the load 114 may include a resistor, a resistor and a diode, or any other circuitry that provides a load to the current reference. The resistor load 114 may be constructed from a region of doped substrate that is not silicided, or may include polysilicon gate, interconnect metal or well resistors if the tolerances are acceptable to the designer.

The current reference also includes a FET 104 coupled to the FET 102 in a current mirror configuration, with drain electrodes and gate electrodes of the FETs 102 and 104 coupled together. The FET 104 is a P-channel FET having its source electrode coupled to the supply voltage Vdd with the gate electrode of the FET 104 coupled to the gate and drain electrode of the FET 102. In addition, the current reference 100 also includes a zero threshold voltage N-channel FET 108 having its drain electrode coupled to the drain electrode of the FET 104. In addition, the gate electrode of the FET 108 is coupled to the gate electrode of the FET 106. Another N-channel FET 112 is provided with its drain electrode coupled to the source electrode of the FET 108. Further, the gate electrode of the FET 112 is coupled to the gate electrode of the FET 110 and also coupled to the drain electrode of the FET 108.

A start-up circuit 119, consisting of a P-channel FET 120, an N-channel FET 122, a P-channel FET 124, a P-channel FET 126, and a P-channel FET 128, generates a positive voltage at each of the gate electrodes of the FET 106, the FET 108, the FET 110, and the FET 112. The start-up circuit 119 insures that a non-zero voltage develops at these gate electrodes. The FETs 124 and 126 turn off after the initial start-up. The FET 128 provides a high impedance coupling to supply to ensure a positive voltage at the coupled gates.

As will be appreciated, the start-up circuit 119 can be designed using one or more FETS, resistors, or any other biasing scheme, including any combination of these. A designer may use any circuitry that performs the stated function of the start-up circuit 119.

The present invention is a CMOS current reference that uses zero threshold voltage N-channel FETs to provide a substantially steady current that is relatively independent of variations in the supply voltage. The current reference 100 is designed to provide high Vdd immunity at low supply voltages, typically in the range of approximately 3.3 volts to approximately 1.5 volts, and even lower. Vdd immunity refers to the ability of a circuit to continue to operate properly or steadily even when noise or variations are present in the Vdd supply, sometimes also referred to as voltage supply rejection (rejection or reduction of the effect of noise or variations in the Vdd supply).

In operation, the threshold voltage difference between FETs 110 and 112 is applied across the resistance R (load 114) to develop a current I. The P-channel FETs 102 and 104 are configured in a current mirror configuration and designed to have a relatively long channel length, at least about two microns. Designing FETs 102 and 104 with a long channel reduces the sensitivity of Ids (the drain to source current in N-channel FETs, or the source to drain current in P-channel FETs) to variations in Vdd, and from channel length modulation effects. Channel length modulation effects are minimized by the relatively long channel and include mask bias tolerances and implant variations that tend to reduce the transistor channel from three-dimensional to two-dimensional. The addition of FETs 106 and 108 configured in a cascade stage between the P-channel FETs 102 and 104 and the N-channel FETs 110 and 112 help improve immunity of the current reference 100 to variations or changes in Vdd. The zero threshold voltage FETs 106 and 108 provide lower body sensitivity than normal N-channel FETs (i.e. FETs having positive threshold voltage) resulting in better linear performance. The ultimate voltage supply rejection depends on the design sizes of FETs 102 and 104 coupled with the design of the cascade stage consisting of FETs 106 and 108. Generally, both the width and length of the channel of the FETs 102 and 104 is relatively large thereby minimizing sensitivity and allowing operation at lower Vdd. The FETs 106 and 108 should also be designed to have relatively longer channel lengths, at least about one micron. Use of N-channel zero threshold voltage FETs in the present invention may generate a power supply rejection of at least approximately 35 dB at a supply voltage of approximately 1.9 volts (i.e. if the supply voltage varies from 1.9 volts to 1.7 volts). For higher supply voltages, additional P-channel FETs may be cascaded to result in relatively high power supply rejection at 2.5 volts.

As will be appreciated, the FET 112 may be designed to have a shorter geometry channel length than the FET 110. This will result in a current that is dependent on the channel length. As channel length increases, the current increases due to the fact that threshold voltage increases as channel length increases, thus increasing the voltage across the resistor R (load 114). This principle may be used in CMOS voltage controlled oscillators or CMOS I/O drivers, and may be used to partially compensate for process variations.

Typically in CMOS systems when the process slows down it is due to the channel length increasing. Since speed is a function of length "L", if a current is developed that increases as the channel length decreases, performance compensation may be achieved. This may reduce the I/O variation if applied to an I/O circuit or may reduce delay variation.

Although the present invention and its advantages have been described in the foregoing detailed description and illustrated in the accompanying drawings, it will be understood by those skilled in the art that the invention is not limited to the embodiment(s) disclosed but is capable of numerous rearrangements, substitutions and modifications without departing from the spirit and scope of the invention as defined by the appended claims.

What is claimed is:

1. A current reference comprising:

circuitry coupled to a voltage supply for generating a substantially steady current despite variations in the voltage level of the voltage supply when a load is coupled to the circuitry, the circuitry comprising a first zero threshold voltage N-channel FET;

a first circuit coupled between the circuitry and the voltage supply for reducing sensitivity of the generated current to variations in the voltage supply, the first circuit comprising a second zero threshold voltage N-channel FET.

2. The current reference in accordance with claim 1 wherein the first circuit further comprises at least one P-channel FET configured in a current source mode.

3. The current reference in accordance with claim 2 wherein the second zero threshold voltage N-channel FET is coupled to the first zero threshold voltage N-channel FET and to the at least one P-channel FET.

4. The current reference in accordance with claim 1 wherein the current reference has at least 35 dB of voltage supply rejection when the voltage supply is approximately 1.9 volts.

5. The current reference in accordance with claim 1 further comprising circuitry for generating a positive voltage coupled to a gate electrode of the first zero threshold voltage N-channel FET and a gate electrode of the second zero threshold voltage N-channel FET.

6. The current reference in accordance with claim 5 wherein the circuitry for generating a positive voltage comprises at least four P-channel FETs and at least one N-channel FET.

7. The current reference in accordance with claim 1 wherein the first circuit comprises a first P-channel FET and a second P-channel FET coupled to the voltage supply and coupled in a current mirror configuration, the first P-channel FET and the second P-channel FET each having a channel length at least two (2) microns.

8. The current reference in accordance with claim 7 wherein the first circuit further comprises a second zero threshold voltage N-channel FET coupled to the first P-channel FET and further coupled to the first zero threshold voltage N-channel FET and a third zero threshold voltage N-channel FET coupled to the second P-channel FET, the second zero threshold voltage N-channel FET and the third zero threshold voltage N-channel FET cascaded to the first P-channel FET and the second P-channel FET, respectively.

9. The current reference in accordance with claim 8 further comprising circuitry for generating a positive voltage coupled to a gate electrode of the first zero threshold voltage N-channel FET and a gate electrode of the second zero threshold voltage N-channel FET and a gate electrode of the third zero threshold N-channel FET.

10. A current reference comprising:

a first P-channel FET coupled to a voltage supply source and configured to operate in a current source mode;

a second zero threshold voltage N-channel FET coupled to the first FET and having a source electrode, a drain electrode and a gate electrode;

a third zero threshold voltage N-channel FET coupled to the voltage supply source and having a source electrode, a drain electrode and a gate electrode, the gate electrode of the third FET coupled to the gate electrode of the second FET;

a fourth zero threshold voltage N-channel FET having a source electrode, a drain electrode and a gate electrode, the drain electrode of the fourth FET coupled to the source electrode of the second FET, the fourth FET outputting a substantially steady current when a load is coupled to the source electrode of the fourth FET;

a fifth N-channel FET having a drain electrode and a gate electrode, the drain electrode of the fifth FET coupled to the source electrode of the third FET and the gate electrode of the fifth FET coupled to the gate electrode of the fourth FET; and circuitry for generating a positive voltage at each of the gate electrodes of the second FET, the third FET, the fourth FET, and the fifth FET.

11. The current reference in accordance with claim 10 wherein the circuitry for generating a positive voltage at each of the gate electrodes of the second FET, the third FET, the fourth FET, and the fifth FET, comprises one or more FETs.

12. A current reference comprising:

a first P-channel FET having a source electrode, a drain electrode and a gate electrode, the source electrode of the first FET coupled to a voltage supply source and the gate electrode of the first FET coupled to the drain electrode of the first FET;

a second P-channel FET having a source electrode, a drain electrode and a gate electrode, the source electrode of the second FET coupled to the voltage supply source and the gate electrode of the second FET coupled to the gate electrode of the first FET;

a third zero threshold voltage N-channel FET having a source electrode, a drain electrode and a gate electrode, the drain electrode of the third FET coupled to the drain electrode of the first FET;

a fourth zero threshold voltage N-channel FET having a source electrode, a drain electrode and a gate electrode, the drain electrode of the fourth FET coupled to the drain electrode of the second FET and the gate electrode of the fourth FET coupled to the gate electrode of the third FET;

a fifth zero threshold voltage N-channel FET having a source electrode, a drain electrode and a gate electrode, the drain electrode of the fifth FET coupled to the source electrode of the third FET, the fifth FET outputting a substantially steady current when a load is coupled to the source electrode of the fifth FET;

a sixth N-channel FET having a source electrode, a drain electrode and a gate electrode, the drain electrode of the sixth FET coupled to the source electrode of the fourth FET and the gate electrode of the sixth FET coupled to the gate electrode of the fifth FET and coupled to the drain electrode of the fourth FET; and circuitry for generating a positive voltage at each of the gate electrodes of the third FET, the fourth FET, the fifth FET, and the sixth FET.

13. The current reference in accordance with claim 12 wherein the circuitry for generating a positive voltage at each of the gate electrodes of the third FET, the fourth FET, the fifth FET, and the sixth FET, comprises one or more FETs.

14. The current reference in accordance with claim 1 further comprising a third N-channel FET having a gate electrode, the gate electrode of the third FET coupled to a gate electrode of the first FET.

15. The current reference in accordance with claim 14 with the first FET having a predetermined channel length and the third FET having a predetermined channel length wherein the channel length of the first FET is greater than the channel length of the third FET.

16. The current reference in accordance with claim 10 with the fourth FET having a predetermined channel length and the fifth FET having a predetermined channel length wherein the channel length of the fourth FET is greater than the channel length of the fifth FET.

17. The current reference in accordance with claim 11 with the first FET having a channel length at least two (2) microns.

18. The current reference in accordance with claim 13 with the fifth FET having a predetermined channel length and the sixth FET having a predetermined channel length wherein the channel length of the fifth FET is greater than the channel length of the sixth FET.

19. The current reference in accordance with claim 12 with the first FET and the second FET each having a channel length at least two (2) microns.

20. The current reference in accordance with claim 1 wherein the current reference has about 35 dB of voltage supply rejection when the voltage supply is approximately 1.9 volts.

21. The current reference in accordance with claim 1 wherein the first circuit comprises a first P-channel FET and a second P-channel FET coupled to the voltage supply and coupled in a current mirror configuration, at least one of the first P-channel FET and the second P-channel FET having a channel length about two (2) microns.

22. The current reference in accordance with claim 10 with the first FET having a channel length about two (2) microns.

23. The current reference in accordance with claim 12 with at least one of the first FET and the second FET having a channel length about two (2) microns.

* * * * *